US008372246B2

(12) United States Patent
Hawes et al.

(10) Patent No.: US 8,372,246 B2
(45) Date of Patent: Feb. 12, 2013

(54) MULTIAXIAL FABRICS

(75) Inventors: John M Hawes, Averill Park, NY (US); Glenn Kornett, Bonneau Beach, SC (US); Bjorn Rydin, Horby (SE); Scott Quigley, Bossier City, LA (US); Michael A Royo, Delmar, NY (US); James G Donovan, Norwell, MA (US); Steven Yook, So. Glens Falls, NY (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 13/185,173

(22) Filed: Jul. 18, 2011

(65) Prior Publication Data

US 2011/0272113 A1 Nov. 10, 2011

Related U.S. Application Data

(62) Division of application No. 12/331,194, filed on Dec. 9, 2008, now Pat. No. 7,981,252, which is a division of application No. 11/116,516, filed on Apr. 28, 2005, now Pat. No. 7,473,336.

(51) Int. Cl.
*D21F 1/10* (2006.01)
*D21F 7/08* (2006.01)
*B32B 5/00* (2006.01)

(52) U.S. Cl. ..... 162/348; 162/900; 162/902; 162/903; 442/247; 442/270

(58) Field of Classification Search ..... 162/348, 162/358.1, 358.2, 900–904; 139/383 A, 139/425 A, 383 AA; 28/110, 142; 442/270, 442/245, 247

See application file for complete search history.

(56) References Cited

U.S. PATENT DOCUMENTS

| | | | | |
|---|---|---|---|---|
| 3,458,911 | A | 8/1969 | Koester | |
| 3,746,053 | A | 7/1973 | Crain | |
| 5,006,399 | A | 4/1991 | Salminen et al. | |
| 5,360,656 | A | 11/1994 | Rexfelt et al. | |
| 5,785,818 | A | 7/1998 | Fekete et al. | |
| 5,916,421 | A | 6/1999 | Yook | |
| 5,939,176 | A | 8/1999 | Yook | |
| 6,117,274 | A | 9/2000 | Yook | |
| 6,331,341 | B1 | 12/2001 | Joyce | |
| 6,723,208 | B1 * | 4/2004 | Hansen | 162/358.2 |
| 6,989,080 | B2 * | 1/2006 | Hansen | 162/375 |
| 6,998,023 | B2 * | 2/2006 | Crook | 162/358.2 |
| 7,407,564 | B2 * | 8/2008 | Hansen | 162/358.2 |
| 2004/0033748 | A1 | 2/2004 | Crook | |
| 2005/0252566 | A1 | 11/2005 | Kornett et al. | |
| 2006/0016508 | A1 | 1/2006 | Westerkamp et al. | |

FOREIGN PATENT DOCUMENTS

| | | | |
|---|---|---|---|
| EP | 1063349 | A | 12/2000 |
| WO | WO 03/080910 | A | 10/2003 |
| WO | WO 2004/099496 | A | 11/2004 |

OTHER PUBLICATIONS

Jan Rexfelt, "Multiaxial Press Fabrics: From Evolution to Revolution", Jan. 30-Feb. 2, 1996, Montreal Canada.

JanBartl, et al., "Inspection of Surface by the Moiré Method", Measurement Science Review, vol. 1, No. 1, 2001, pp. 29-32.

Philip R. Elkins, "A Primary Driving Force for Current Trends and Developments", Board Technology Days 2001, pp. 77-84.

* cited by examiner

*Primary Examiner* — Eric Hug

(74) *Attorney, Agent, or Firm* — Frommer Lawrence & Haug LLP; Ronald R. Santucci

(57) ABSTRACT

The present invention provides a multilayer multiaxial woven fabric for a papermachine having a reduced interference pattern and accordingly improved dewatering uniformity. The present invention also provides a method of forming such multilayer multiaxial fabric.

8 Claims, 17 Drawing Sheets

MULTIAXIAL FABRICS

This application is a Divisional of and claims priority from U.S. application Ser. No. 12/331,194 filed Dec. 9, 2008 which will be granted as U.S. Pat. No. 7,981,252 on Jul. 19, 2011, which is a Divisional of and claims priority from 11/116,516, filed Apr. 28, 2005, which was granted as U.S. Pat. No. 7,473,336 on Jan. 6, 2009, the disclosures of which are hereby incorporated by reference in their entireties.

BACKGROUND OF THE INVENTION

1. Field of the Invention

The present invention relates to improvements in multilayer multiaxial fabrics for use in a papermaking machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

The present invention relates primarily to the fabrics used in the press section, generally known as press fabrics, but it may also find application in the fabrics used in the forming and dryer sections, as well as in those used as bases for polymer-coated paper industry process belts, such as, for example, long nip press belts.

Press fabrics play a critical role during the paper manufacturing process. One of their functions, as implied above, is to support and to carry the paper product being manufactured through the press nips.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Perhaps most importantly, the press fabrics accept the large quantities of water extracted from the wet paper in the press nip. In order to fulfill this function, there literally must be space, commonly referred to as void volume, within the press fabric for the water to go, and the fabric must have adequate permeability to water for its entire useful life. Finally, press fabrics must be able to prevent the water accepted from the wet paper from returning to and rewetting the paper upon exit from the press nip.

Contemporary press fabrics are used in a wide variety of styles designed to meet the requirements of the paper machines on which they are installed for the paper grades being manufactured. Generally, they comprise a woven base fabric into which has been needled a batting of fine, non-woven fibrous material. The base fabrics may be woven from monofilament, plied monofilament, multifilament or plied multifilament yarns, and may be single-layered, multi-layered or laminated. The yarns are typically extruded from any one of several synthetic polymeric resins, such as polyamide and polyester resins, used for this purpose by those of ordinary skill in the paper machine clothing arts.

Woven fabrics take many different forms. For example, they may be woven endless, or flat woven and subsequently rendered into endless form with a seam. Alternatively, they may be produced by a process commonly known as modified endless weaving, wherein the widthwise edges of the base fabric are provided with seaming loops using the machine-direction (MD) yarns thereof. In this process, the MD yarns weave continuously back and forth between the widthwise edges of the fabric, at each edge turning back and forming a seaming loop. A base fabric produced in this fashion is placed into endless form during installation on a paper machine, and for this reason is referred to as an on-machine-seamable fabric. To place such a fabric into endless form, the two widthwise edges are seamed together. To facilitate seaming, many current fabrics have seaming loops on the crosswise edges of the two ends of the fabric. The seaming loops themselves are often formed by the machine-direction (MD) yarns of the fabric. The seam is typically formed by bringing the two ends of the fabric press together, by interdigitating the seaming loops at the two ends of the fabric, and by directing a so-called pin, or pintle, through the passage defined by the interdigitated seaming loops to lock the two ends of the fabric together.

Further, the woven base fabrics may be laminated by placing one base fabric within the endless loop formed by another, and by needling a staple fiber batting through both base fabrics to join them to one another. One or both woven base fabrics may be of the on-machine-seamable type.

In any event, the woven base fabrics are in the form of endless loops, or are seamable into such forms, having a specific length, measured longitudinally therearound, and a specific width, measured transversely thereacross. Because paper machine configurations vary widely, paper machine clothing manufacturers are required to produce press fabrics, and other paper machine clothing, to the dimensions required to fit particular positions in the paper machines of their customers. Needless to say, this requirement makes it difficult to streamline the manufacturing process, as each press fabric must typically be made to order.

In response to this need to produce press fabrics in a variety of lengths and widths more quickly and efficiently, press fabrics have been produced in recent years using a spiral winding technique disclosed in commonly assigned U.S. Pat. No. 5,360,656 to Rexfelt et al. (the '656 patent), the teachings of which are incorporated herein by reference.

The '656 patent shows a press fabric comprising a base fabric having one or more layers of staple fiber material needled thereinto. The base fabric comprises at least one layer composed of a spirally wound strip of woven fabric having a width which is smaller than the width of the base fabric. The base fabric is endless in the longitudinal, or machine, direction. Lengthwise threads of the spirally wound strip make an angle with the longitudinal direction of the press fabric. The strip of woven fabric may be flat-woven on a loom which is narrower than those typically used in the production of paper machine clothing.

The base fabric comprises a plurality of spirally wound and joined turns of the relatively narrow woven fabric strip. The fabric strip, if flat woven, is woven from lengthwise (warp) and crosswise (filling) yarns. Adjacent turns of the spirally wound fabric strip may be abutted against one another, and the spirally continuous seam so produced may be closed by sewing, stitching, melting, welding (e.g. ultrasonic) or gluing. Alternatively, adjacent longitudinal edge portions of adjoining spiral turns may be arranged overlappingly, so long as the edges have a reduced thickness, so as not to give rise to an increased thickness in the area of the overlap. Alternatively still, the spacing between lengthwise yarns may be increased at the edges of the strip, so that, when adjoining spiral turns are arranged overlappingly, there may be an unchanged spacing between lengthwise threads in the area of the overlap.

A multiaxial press fabric may be made of two or more separate base fabrics with yarns running it at least four different directions. Whereas the standard press fabrics of the prior art have three axes: one in the machine direction (MD), one in the cross-machine direction (CD), and one in the z-direction, which is through the thickness of the fabric, a multiaxial press fabric has not only these three axes, but also has at least two more axes defined by the directions of the yarn systems in its spirally wound layer or layers. Moreover, there are multiple flow paths in the z-direction of a multiaxial press fabric. As a consequence, a multiaxial press fabric has at least five axes. Because of its multiaxial structure, a multiaxial press fabric having more than one layer exhibits superior resistance to nesting and/or to collapse in response to compression in a press nip during the papermaking process as compared to one having base fabric layers whose yarn systems are parallel to one another.

The fact that there are two separate base fabrics, on top of the other, means that the fabrics are "laminated" and each layer can be designed for a different functionality. In addition, the separate base fabrics or layers are typically joined together in a manner well known to the skilled artisan including, depending upon the application, as aforesaid the needling of batt therethrough.

As mentioned above, the topography of a press fabric contributes to the quality of the paper sheet. A planar topography provides a uniform pressing surface for contacting the paper sheet and reducing press vibrations. Accordingly, efforts have been made to create a smoother contact surface on the press fabric. But surface smoothness may be limited by the weave pattern forming the fabric. Cross-over points of interwoven yarns form knuckles on the surface of the fabric. These knuckles may be thicker in the z-direction than the remaining areas of the fabric. Consequently, the surface of the fabric may have a non-planar topography characterized with localized areas of varying thickness, or caliper variation, which may cause sheet marking during a pressing operation. Caliper variation can even have an adverse effect on a batt layer resulting in non-uniform batt wear, compression and marking.

Laminated press fabrics, specifically multiaxial fabrics, may have such caliper variation. Specifically, in the special case of a multiaxial fabric having two layers with the same weave pattern, localized caliper variation is intensified. Therefore, a need exists for a multiaxial press fabric with reduced caliper variation to improve pressure distribution and reduce sheet marking during operation.

SUMMARY OF THE INVENTION

The present invention provides a multilayer fabric for a papermachine having improved pressing uniformity and reduced sheet marking.

The invention in one embodiment provides a multilayer fabric formed from two or more base structures or layers, which may include a layer or layers formed from multiaxial strips of material or layers of fabric in combination therewith for use on a papermachine. In the first embodiment, the fabric includes at least one layer having a plurality of machine direction (MD) yarns and cross-machine direction (CD) yarns interwoven in a predetermined manner such that a distance between MD yarns varies and/or the distance between CD yarns also varies such that there is a reduction of the interference pattern or the Moire Effect as between the layers making up the fabric.

In the second embodiment, the present invention provides for a multilayer fabric for use with a papermachine including an upper woven layer, a lower woven layer formed for example in a manner as described in U.S. Pat. No. 5,939,176 to Yook (the '176 patent) with however a nonwoven layer disposed therebetween so as to create void volume, maintain fabric openness and lessen or eliminate interference patterns between the woven layers.

In a third embodiment, the present invention provides for a multilayer fabric for use with a papermachine which may be formed for exampled in a manner described in the '656 or '176 patents including an upper woven layer and a lower woven layer with the inside of the upper layer and the inside of the lower layer flattened or calendered to reduce the height of knuckles thereon, so as to minimize nesting therebetween and thereby lessen or eliminate localized caliper variations and/or interference patterns between the woven layer.

In a fourth embodiment, the present invention provides for a multilayer fabric for use with a papermachine. One or more layers being woven of MD and CD yarns. A plurality of MD yarns and a first plurality of CD yarns form a first shed pattern, and the plurality of MD yarns and a second plurality of CD yarns form a second shed pattern, such that when they are placed on top of each other so as to create the multilayered fabric, the interference pattern therebetween is lessened.

Note the numbering of the various embodiments is merely for clarity and readability purposes and should in no way indicate a particular order of preference or importance.

The present invention will now be described in more complete detail with reference being made to the figures wherein like reference numerals denote like elements and parts, which are identified below.

BRIEF DESCRIPTION OF THE DRAWINGS

For a more complete understanding of the invention, reference is made to the following description and accompanying drawings, in which.

DETAILED DESCRIPTION

Multilayer fabrics may include two or more base substrates or layers. The present invention is, however, particularly suited for multilayer, multiaxial fabrics. That being fabrics made of strips of material such as those described in the aforesaid '656 patent. While the present invention has particular application with regard to layers of woven strips of material, other construction of the strips as, for example, mesh and MD and CD yarn arrays among others that may exhibit the Moire Effect when layered may also be suitable for application as to one or more of the embodiments discussed herein. Also, it should be further understood that the layers of fabric may be a combination of layers such as layers of multiaxial layers with a layer of traditional endless woven fabric or some combination thereof and joined together by needling or in any other manner suitable for that purpose.

With that in mind, the invention will be described using as an example a multiaxial woven fabric having at least two layers which may be separate layers such as that described in the '656 patent. It also could be for example an endless multiaxial fabric folded upon itself along first and second fold lines such as that described in the '176 patent, or some combination thereof. In this regard, the present invention provides for a multiaxial press fabric including a first (upper) woven layer and second (lower) woven layer, each layer having a plurality of interwoven MD yarns and CD yarns. Multiaxial fabrics may be further characterized as having yarns running in at least two different directions. Due to the spiral of the strips of material which form the fabric, the MD yarns are at a slight angle with the machine direction of the fabric. A relative angle or offset is also formed between the MD yarns of the first layer with the MD yarns of the second layer when laid thereon. Similarly, the CD yarns of the first layer being perpendicular to the MD yarns of the first layer, form the same angle with the CD yarns of the second layer. In short, neither the MD yarns nor the CD yarns of the first layer align with the MD yarns or the CD yarns of the second layer when a spiral formed fabric are laid upon each other to create a multilayer fabric.

Figure 1:
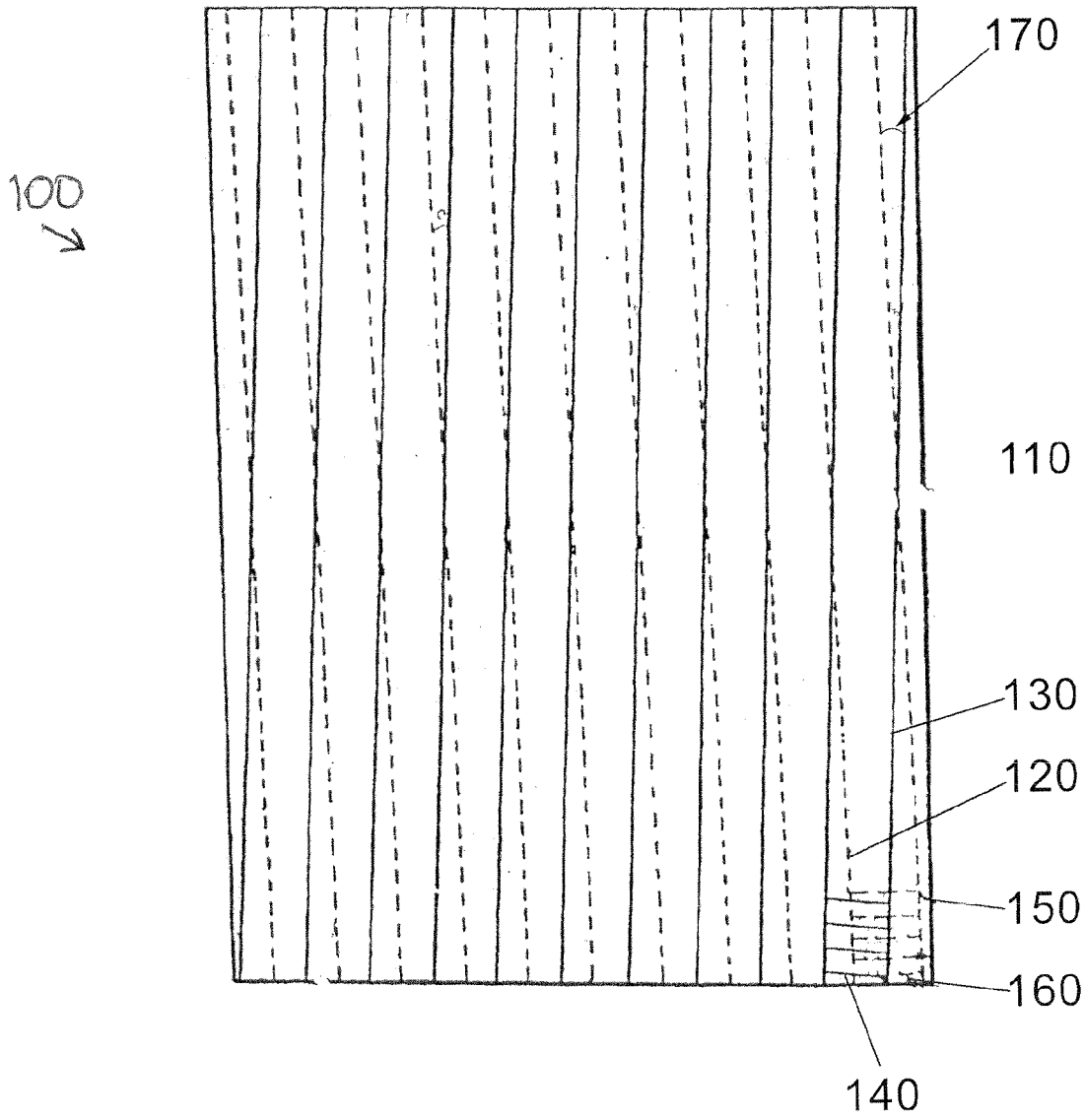
FIG. 1 is a top view of a multilayer multiaxial fabric in the form of an endless loop.

Turning now specifically to FIG. 1. there is shown a typical multilayer multiaxial fabric 100 having a first (upper) layer 110 and a second (lower) layer 120 in the form of an endless loop. First layer 110 has MD yarns 130 and CD yarns 140. Similarly, second layer 120 has MD yarns 150 and CD yarns 160. Further, a relative angle or offset 170 is formed between MD yarn 130 and MD yarn 150. Once multiaxial fabric 100 has been assembled, it may be rendered into endless form with a seam as shown, for example, in the '176 patent in addition to U.S. Pat. Nos. 5,916,421 (the '421 patent) and 6,117,274 (the '274 patent). As may be appreciated, other ways of forming multiaxial fabric 100 would be readily apparent to those of skill in the art. In addition, all patents referred to herein are incorporated herein by reference as if fully set forth herein.

In laminated press fabrics (those consisting of two or more base structures or layers as shown in FIG. 1) such fabrics exhibit some characteristic interference or Moire Effect that is a function of the spacing and size of both MD and CD yarns. This Effect is enhanced if the yarns are single monofilament yarns, especially as the diameter increases and count decreases. The Effect exists in multiaxial fabrics since the orthogonal yarn systems of one layer is not parallel or perpendicular to those of the other layers.

Multiaxial multilayer fabric structures have provided many papermaking performance benefits because of their ability to resist base fabric compaction better than conventional, endless woven laminate structures. The reason for this is that, in the case of, for example, a two-layer multiaxial laminate, orthogonal yarn systems of one layer are not parallel or perpendicular to those of the other laminated layer. However, because of this, the relative angle between the respective MD and CD yarn systems of each layer (i.e. layers 110 and 120) ranges in practicality from 1 to 7° offset. The effect of this angle is that it greatly intensifies the Moire Effect and causes the planarity of the interfacial topography to deteriorate. It should be noted that in the case of most laminated multilayer fabrics whether or not multiaxial, the Moire Effect may occur since yarn alignment between layers is not often perfect.

Figure 2:
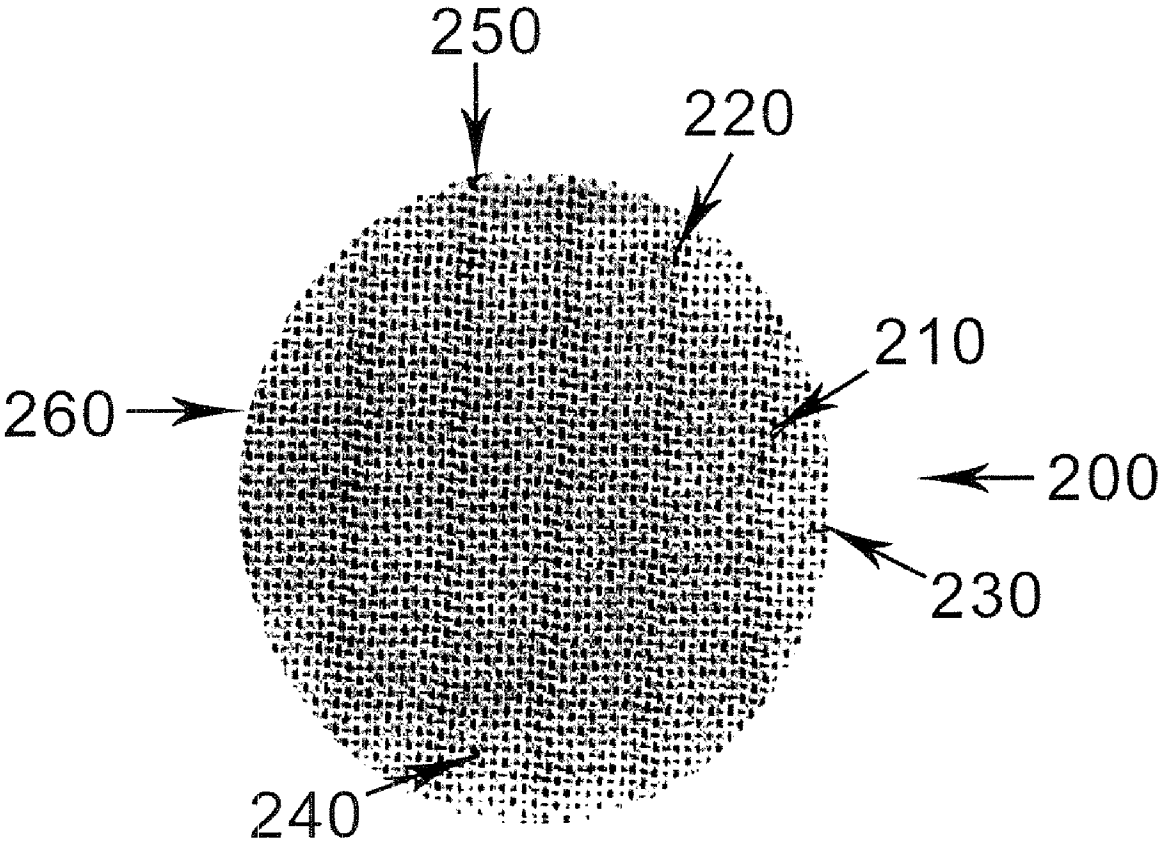
FIG. 2 is an interference pattern formed from carbon impressions of a multilayer multiaxial fabric.

The Effect in this regard is shown in FIG. 2 where an interference pattern 200 is formed in a prior art multilayer multiaxial press fabric illustrated. Interference patterns are characteristic of the yarn arrangement forming a multilayer multiaxial fabric and illustrate the pressure distribution of the press fabric during operation. Here, interference pattern 200 is formed from carbon impression of a multilayer multiaxial fabric having monofilament yarns in both directions. Contact points 210 indicate areas of pressure concentration exerted on the sheet during a pressing operation. Specifically, dark contact point 220 is an area of highest pressure which may indicate a high caliper area. The high caliper area may result from knuckles formed from overlapping yarns in the first and second layers. In contrast, light contact point 230 is an area of lower pressure which may indicate a low caliper area. Further, open area 240 may be an area where no yarns intersect.

The pattern of light contact points 230 and dark contact points 220 indicates a non-planar topography and a non-uniform pressure distribution. Specifically, MD bands 250 and CD bands 260 form areas of high caliper and exemplify caliper variation. This visual representation is known as a Moire Effect.

Caliper variation may be a function of the spacing and size of the intersecting yarns in each layer of the fabric. Therefore, as the diameter of yarns increase and the number of yarns in a specified area, or count, decreases, the localized caliper variation is more prominent and objectional sheet marking may occur.

An interference pattern for a multilayer multiaxial fabric is generated by superposing a first woven layer onto the plane of the second woven layer. Using a modeling program you can generate interference patterns and topography for any combination of layers in multiaxial fabrics.

Figure 3:
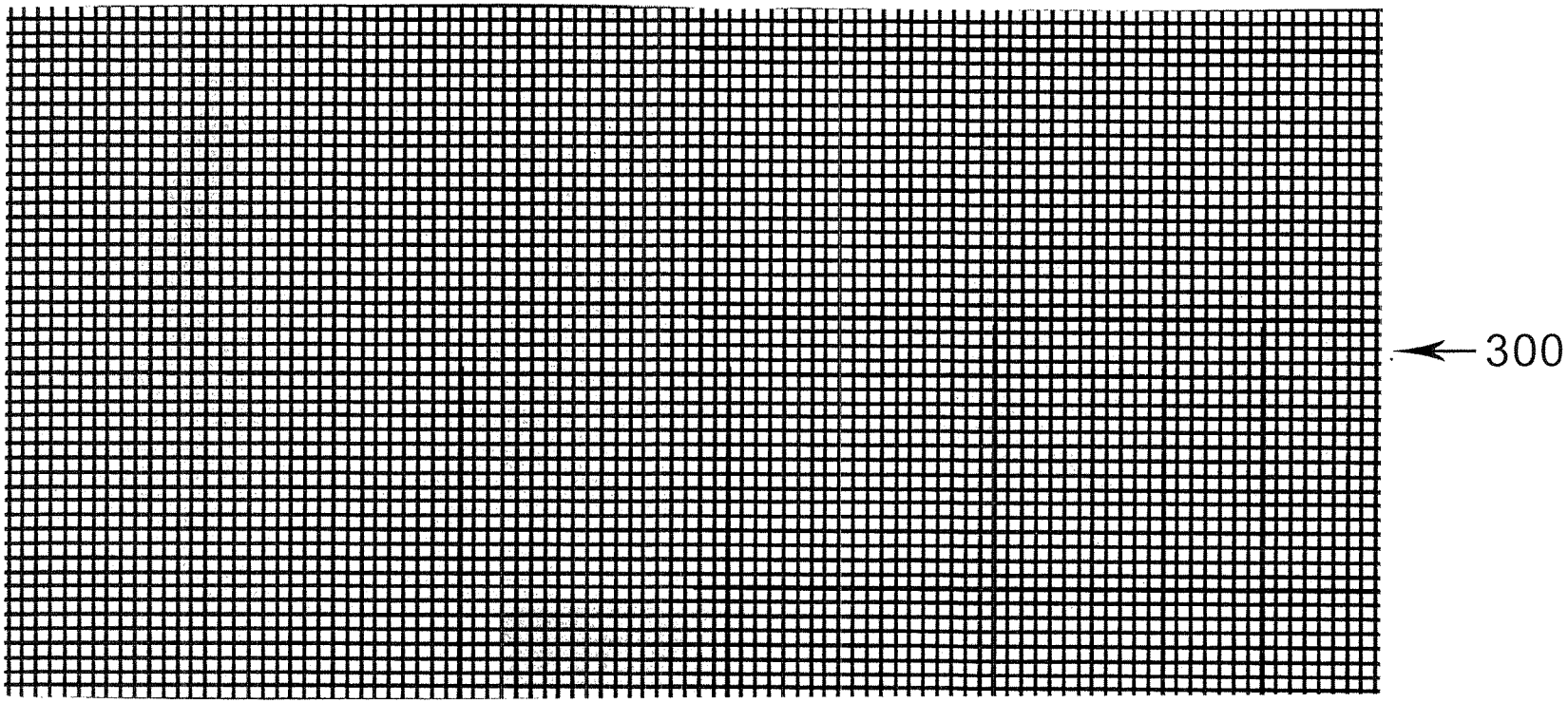
FIG. 3 is an interference pattern of a prior art multilayer fabric having an offset of 0°.

FIG. 3 is an interference pattern 300 of a fabric formed by superposing a first woven layer onto the plane of a second woven layer. The fabric is formed from two layers having plain weave of monofilament yarns having an offset of 0°. In other words, there is no multiaxial effect provided by each layer. As shown, the yarns of the first layer entirely overlap the yarns of the second layer.

Figure 4:
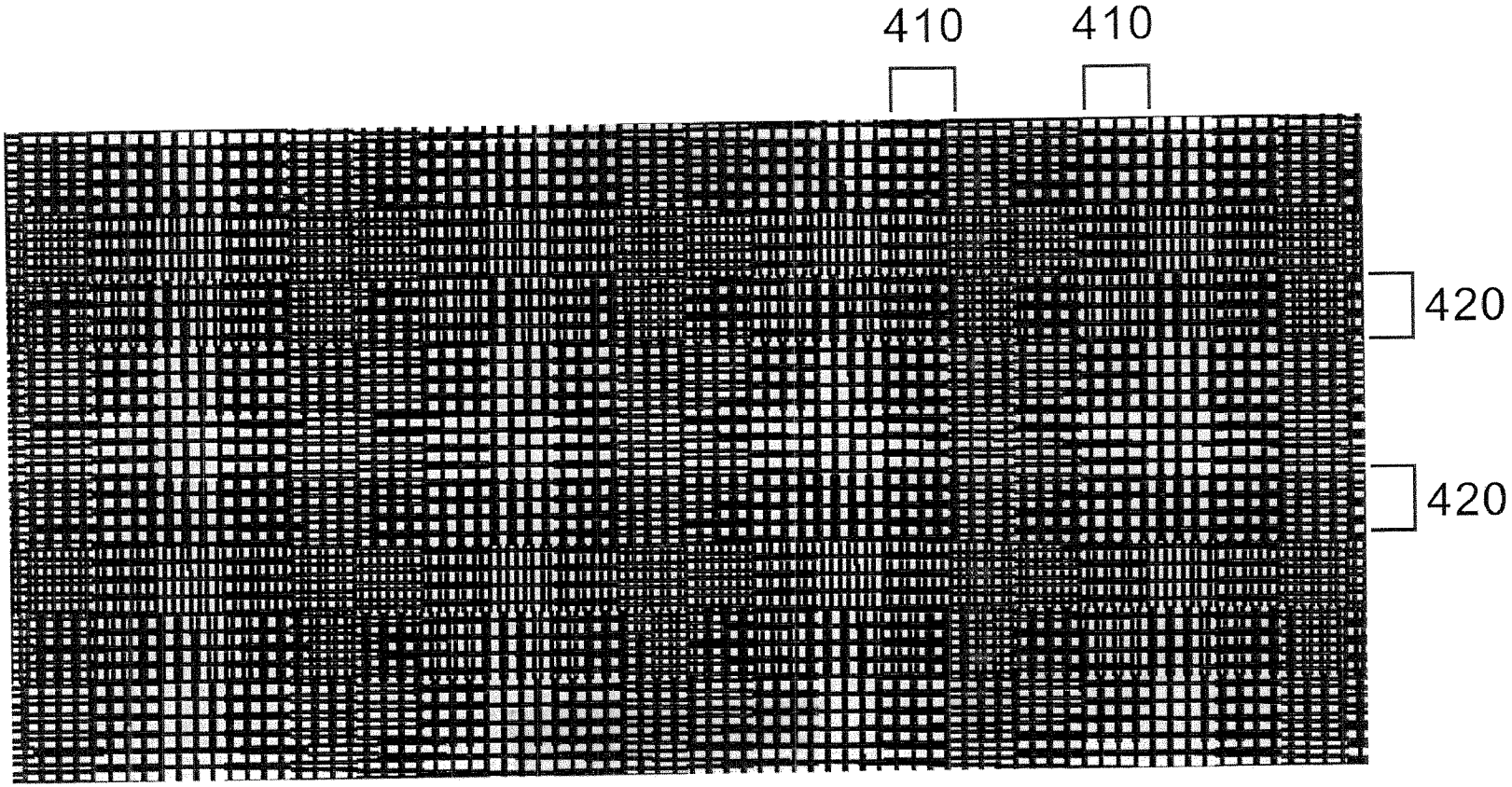
FIG. 4 is an interference pattern of a prior art multilayer multiaxial fabric having an offset of 3°.

FIG. 4 is an interference pattern 400 of a multiaxial multilayer fabric formed from the same woven fabric layers 110 and 120 as in FIG. 3, but having an offset of 3° from each other. MD bands 410 and CD bands 420 are clearly visible, which may indicate caliper, mass and/or pressure variation. Such a fabric when in use may result in non-uniform drainage of water from the paper sheet which obviously would be undesirable.

Figure 5:
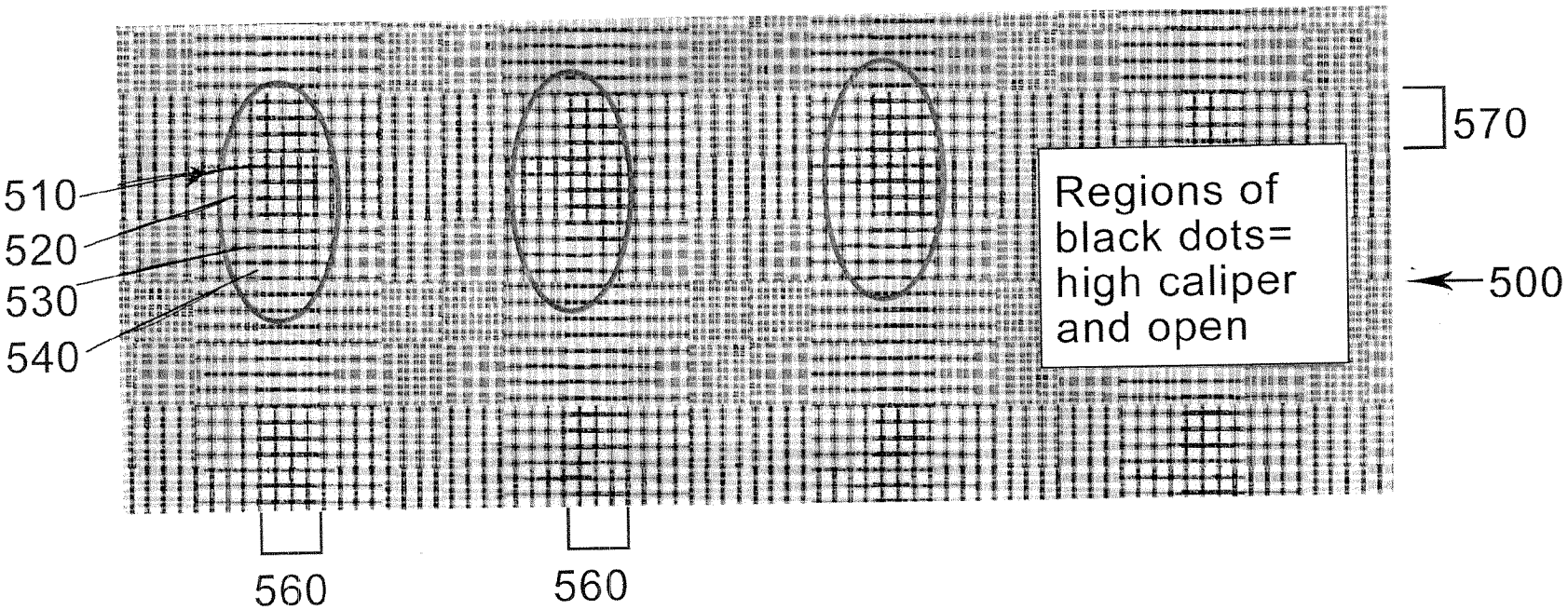
FIG. 5 is a representation of the topography of the prior art multilayer multiaxial fabric depicted in FIG. 4.

FIG. 5 is a representation of the topography 500 of the multiaxial multilayer fabric depicted in FIG. 4 having points or regions 510, 520, 530, 540 and 550. Black point or region 510 represents an area where 4 yarns cross, dark grey 520 represents a point of region where 3 yarns cross, medium gray 530 represents a point or region where 2 yarns cross, and white 550 is open area. As shown, the topography may be non-planer with MD bands 560 and CD bands 570.

Figure 6:
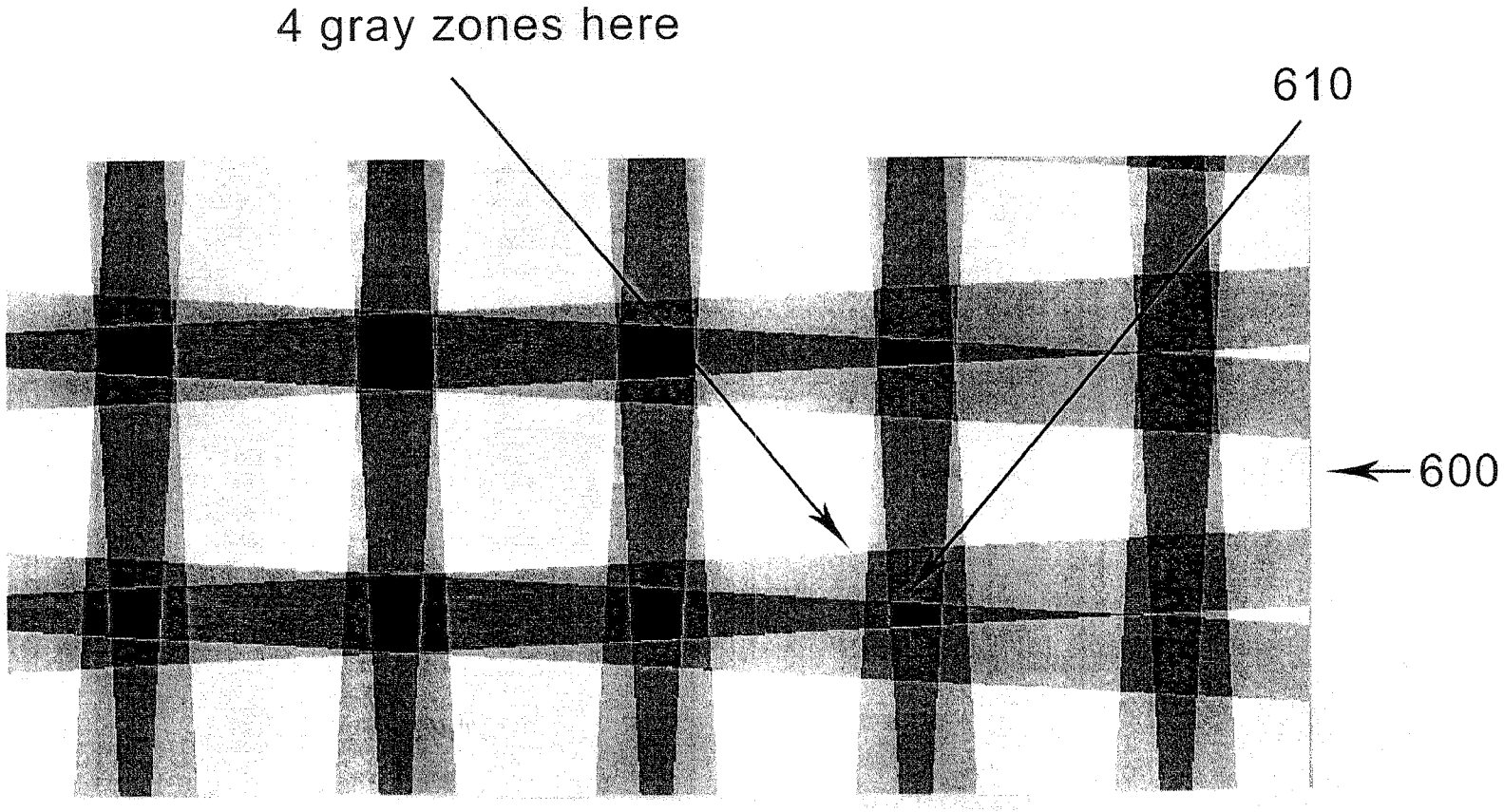
FIG. 6 is a representation of the topography of a prior art multilayer multiaxial fabric having an offset of 6°.

FIG. 6 is a representation of the topography 600 of the multiaxial multilayer fabric depicted in FIG. 4, with an offset of 6° between layers. As shown, the topography is non-planer. In this close-up representation, the caliper, mass and pressure variation of the fabric is clearly shown. More specifically, region 610 indicates an area where four yarns overlap. The pattern of the points may result in MD bands and CD bands as aforenoted well.

Figure 7:
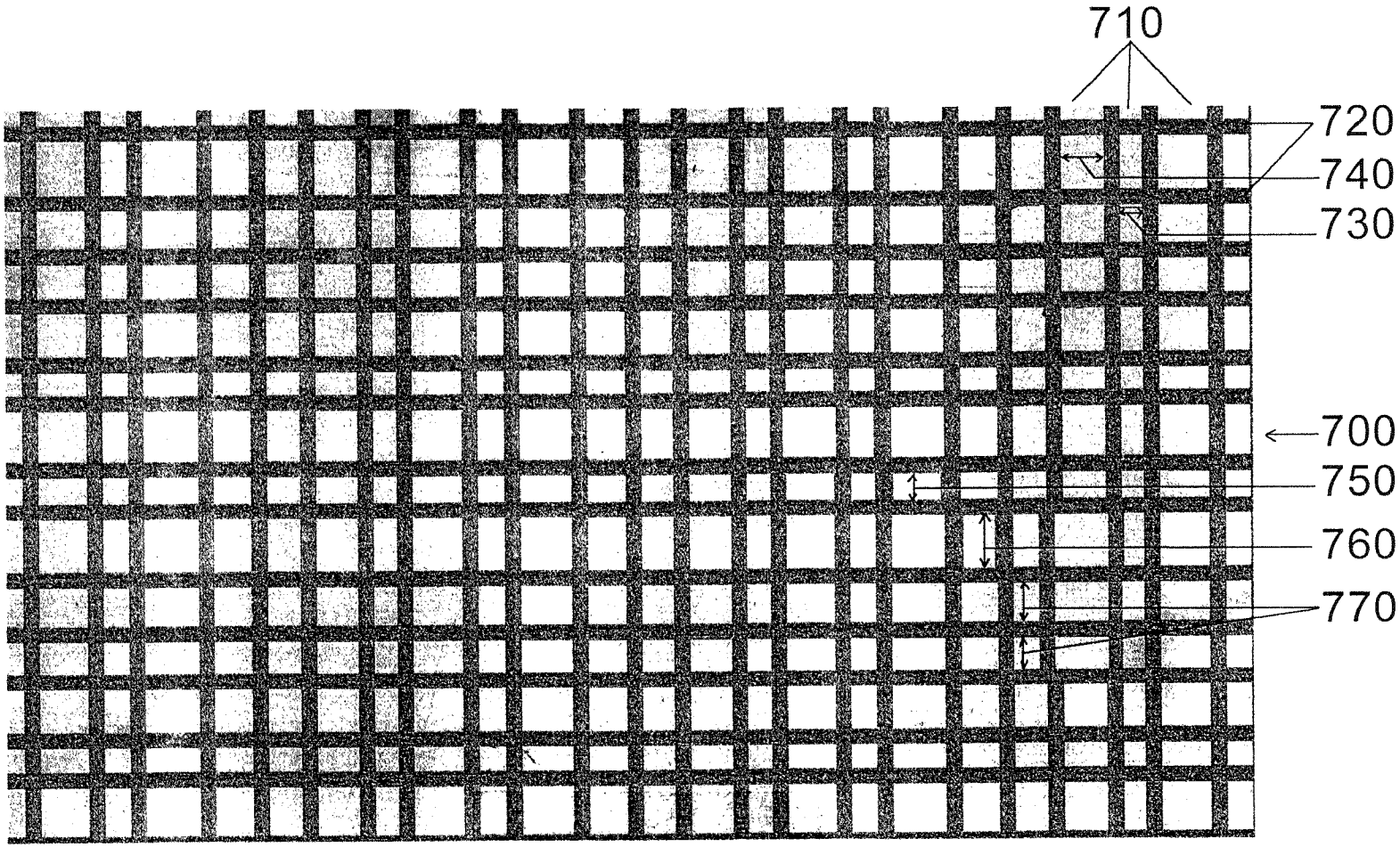
FIG. 7 is a layer of a multilayer multiaxial fabric in accordance with the first embodiment of the present invention.

Turning now to FIG. 7 there is shown layer 700 in accordance with the first embodiment of the present invention. Layer 700 includes a plurality of MD yarns 710 and CD yarns 720 interwoven in a predetermined manner. The distance or spacing 730 between one pair of adjacent MD yarns 710 is different than the distance or spacing 740 between another pair of adjacent MD yarns 710. Further, the distance 750 between one pair of adjacent CD yarns 720 is different than the distance 760 between another pair of adjacent CD yarns 720. That is, layer 700 has variable distances or spacing between pairs of adjacent MD yarns 710 and variable distances or spacing between pairs of adjacent CD yarns 720. This purposeful introduction of what might be considered "non-uniformity" into each layer is such that the net non-uniformity effect is less.

Although, the variable distances are shown between adjacent pairs of adjacent MD yarns and between adjacent pairs of adjacent CD yarns, the invention is not so limited. A variable distance or spacing between pairs of adjacent MD yarns and/or between pairs of adjacent CD yarns may be arranged in any manner. For example, distance 750 between one pair of adjacent CD yarns 720 may be followed by a distance 760 between another pair of adjacent CD yarns 720 followed by a distance 770 between another pair of adjacent CD yarns 720 and so forth, or a number of distances 750 between pairs of adjacent of CD yarns 720 followed by a number of distances 760 between adjacent pairs of CD yarns followed by a number of distances 770 and so forth. Further, there may be only one distance between pairs of adjacent CD yarns throughout the length of the fabric that may be different than the remaining distances between pairs of adjacent CD yarns. Alternatively, all the distances between pairs of adjacent CD yarns may be different. The variable distances described between pairs of adjacent CD yarns may be applied to the distances between pairs of adjacent MD yarns. Such arrangement of variable distances between pairs of adjacent MD yarns and between pairs of adjacent CD yarns may improve pressing uniformity and reduce sheet marking. Any combination of distances between MD yarns and/or CD yarns is envisioned in the present invention.

Figure 8:
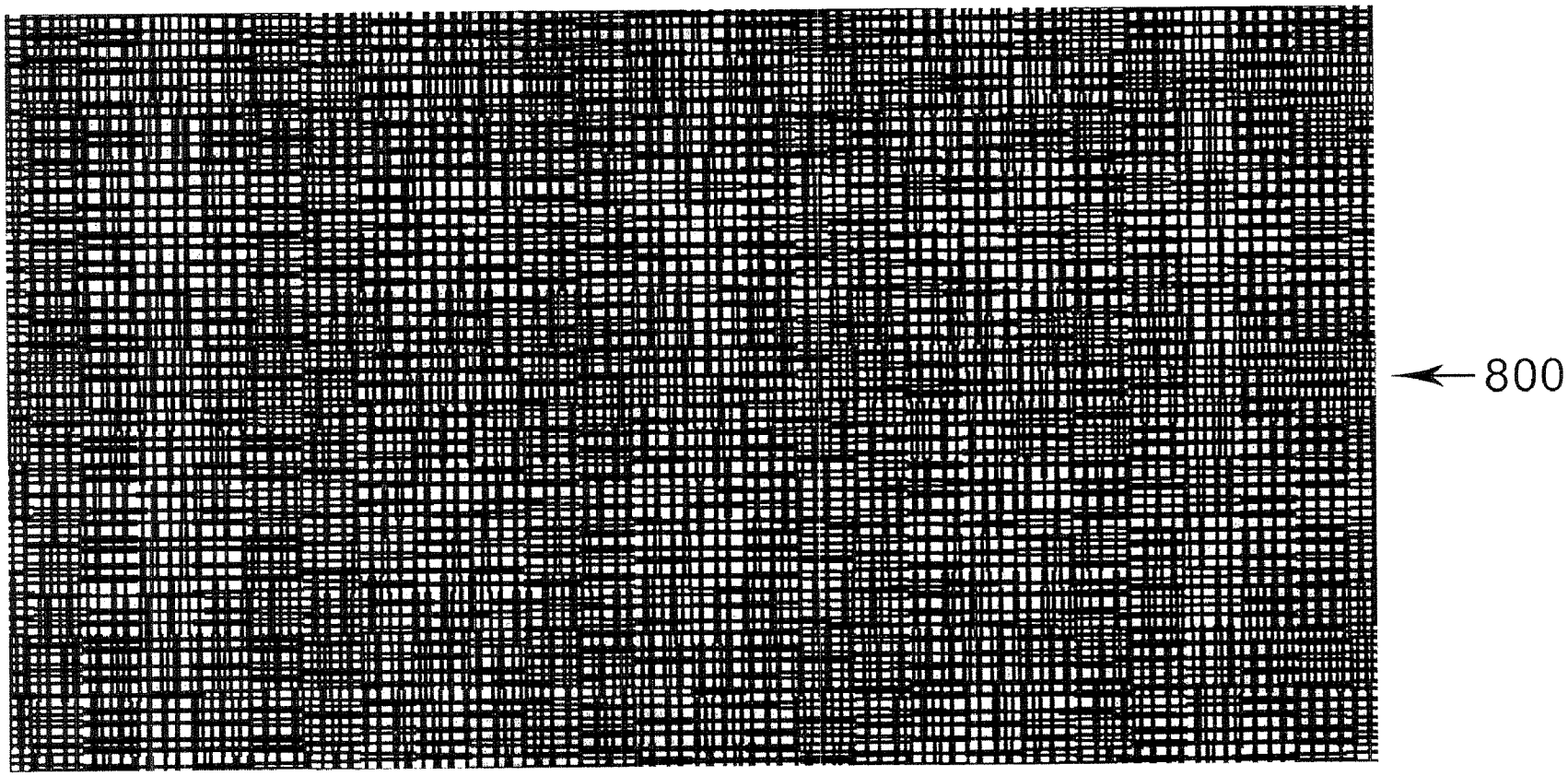
FIG. 8 is an interference pattern of a multilayer multiaxial fabric having two layers, each layer having the variable MD yarn spacing depicted in FIG. 7.
Figure 9:
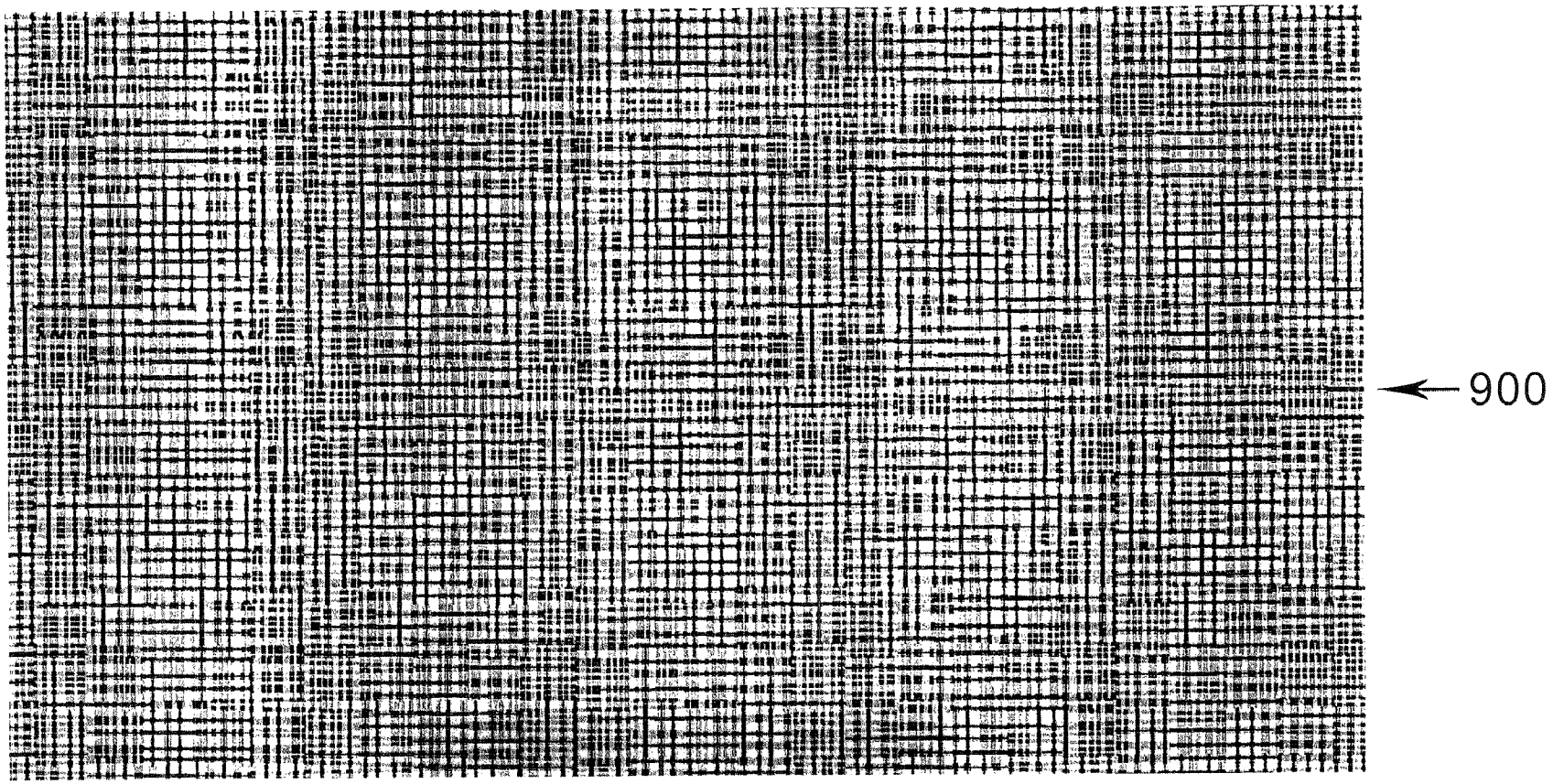
FIG. 9 is a representation of the topography of the multilayer multiaxial fabric depicted in FIG. 8.

FIGS. 8 and 9 are the interference pattern and topography of the multilayer multiaxial fabric having a first layer and a second layer in the staggered arrangement of varying MD and CD spaces as shown in FIG. 7. Each layer is offset of 3° from each other. As shown in FIGS. 8 and 9, in varying MD and CD bands that are characteristic of multilayer multiaxial fabrics (compare FIGS. 2, 4, and 5) has been reduced or eliminated. Accordingly, the topography of the fabric is more uniform and should result in improved pressing uniformity with reduced sheet marking.

Note that to implement the desired spacing of, for example, the MD and/or CD yarns is readily accomplished by the skilled artisan. In this regard, predetermined distances between pairs of adjacent CD yarns may be achieved by a programmed servo control of length factor in weaving or selective weave patterns to force non-uniform or variable grouping, and/or use of randomly or non-randomly inserted dissolving yarns. For example, in FIG. 10 layer 1000 is a pattern, for example, which has a plurality of interwoven MD yarns 1010 and CD yarns 1020, with variable CD spacing. That is, a first spacing 1030 is different than a second spacing 1040. While the CD spacing varies in this illustration, the MD spacing 1050 does not. Accordingly, the variations and combinations are infinite.

Figure 10:
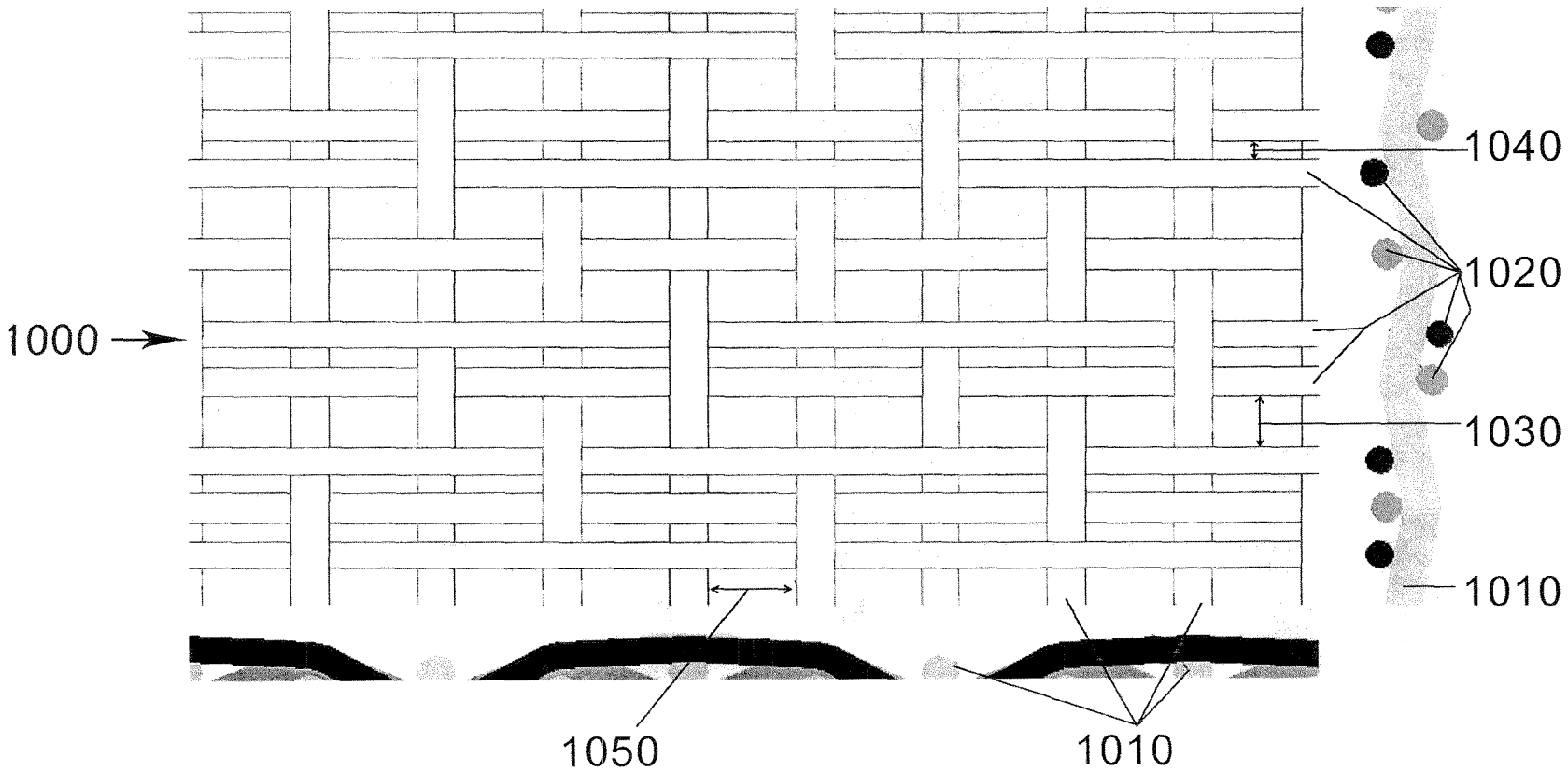
FIG. 10 is a layer of a multilayer multiaxial fabric having variable CD yarn spacing in accordance with the first embodiment of the present invention.
Figure 10A:
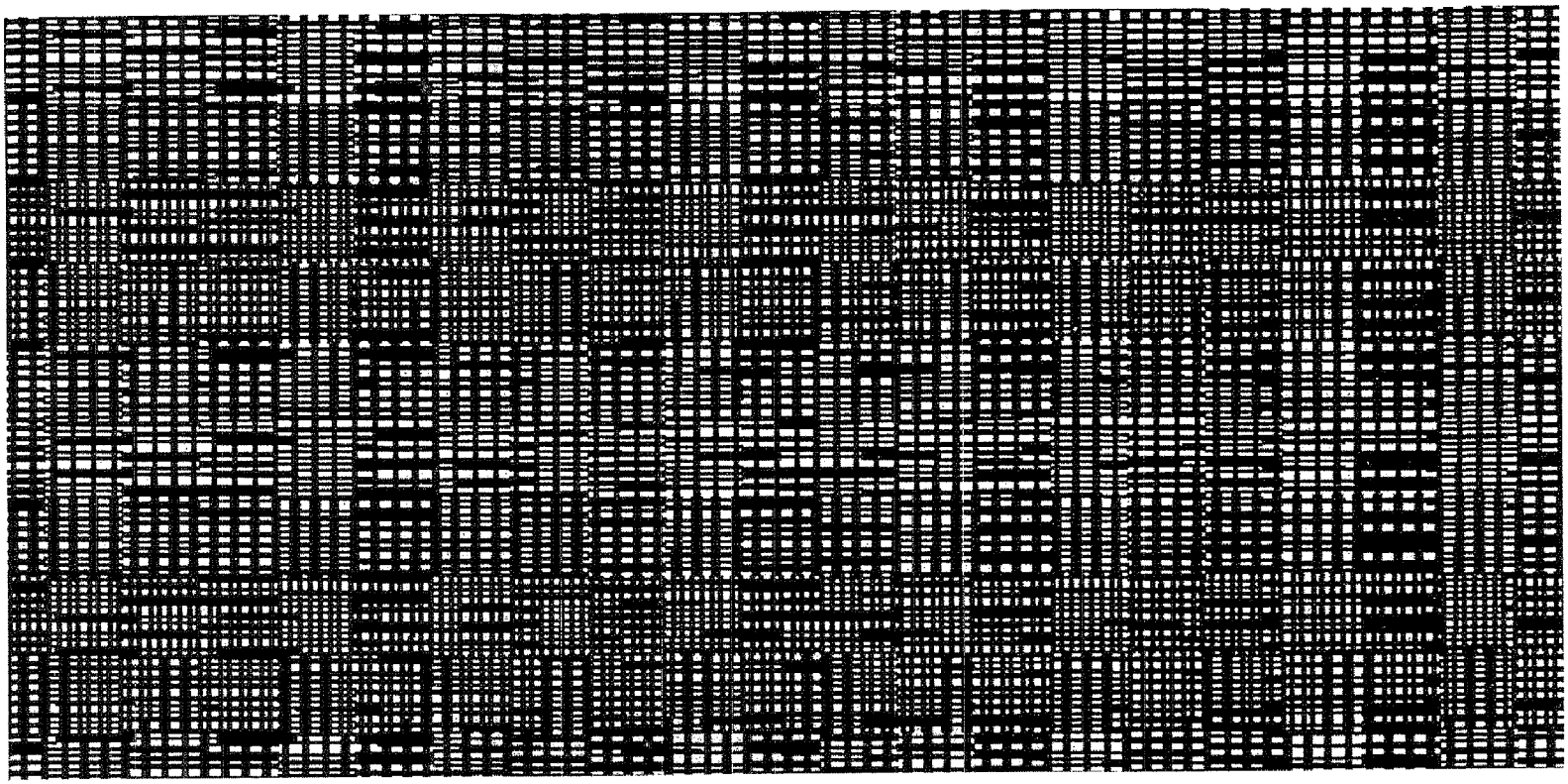
FIG. 10*a* is an interference pattern of a multilayer fabric having two layers, each layer having the weave pattern depicted in FIG. 10.
Figure 10B:
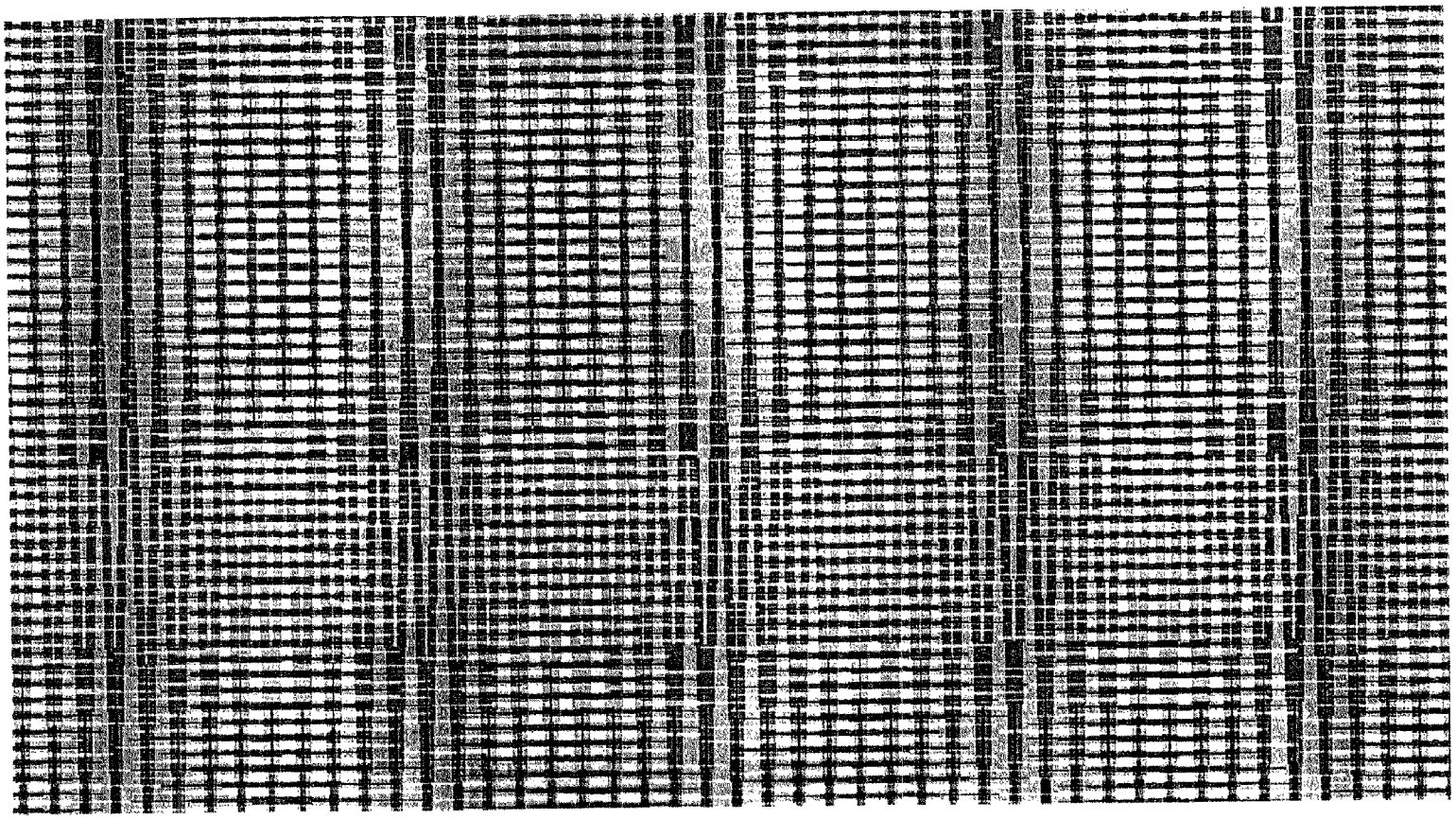
FIG. 10*b* is a representation of the topography of the multilayer multiaxial fabric depicted in FIG. 10*a;*

FIGS. 10*a* and 10*b* are the interference pattern and topography of the multiaxial fabric having a first layer and a second layer formed from the weave pattern depicted in FIG. 10. As shown in FIGS. 10*a* and 10*b*, the higher CD yarn count and the variable spaced CD yarns depicted in the weave pattern of FIG. 10 result in minimizing MD and CD bands, compared to that of FIGS. 4 and 5. Accordingly, the topography of a multiaxial multilayer fabric can be rendered more uniform, which should result in improved pressing uniformly and reduced sheet marking.

Figure 11:
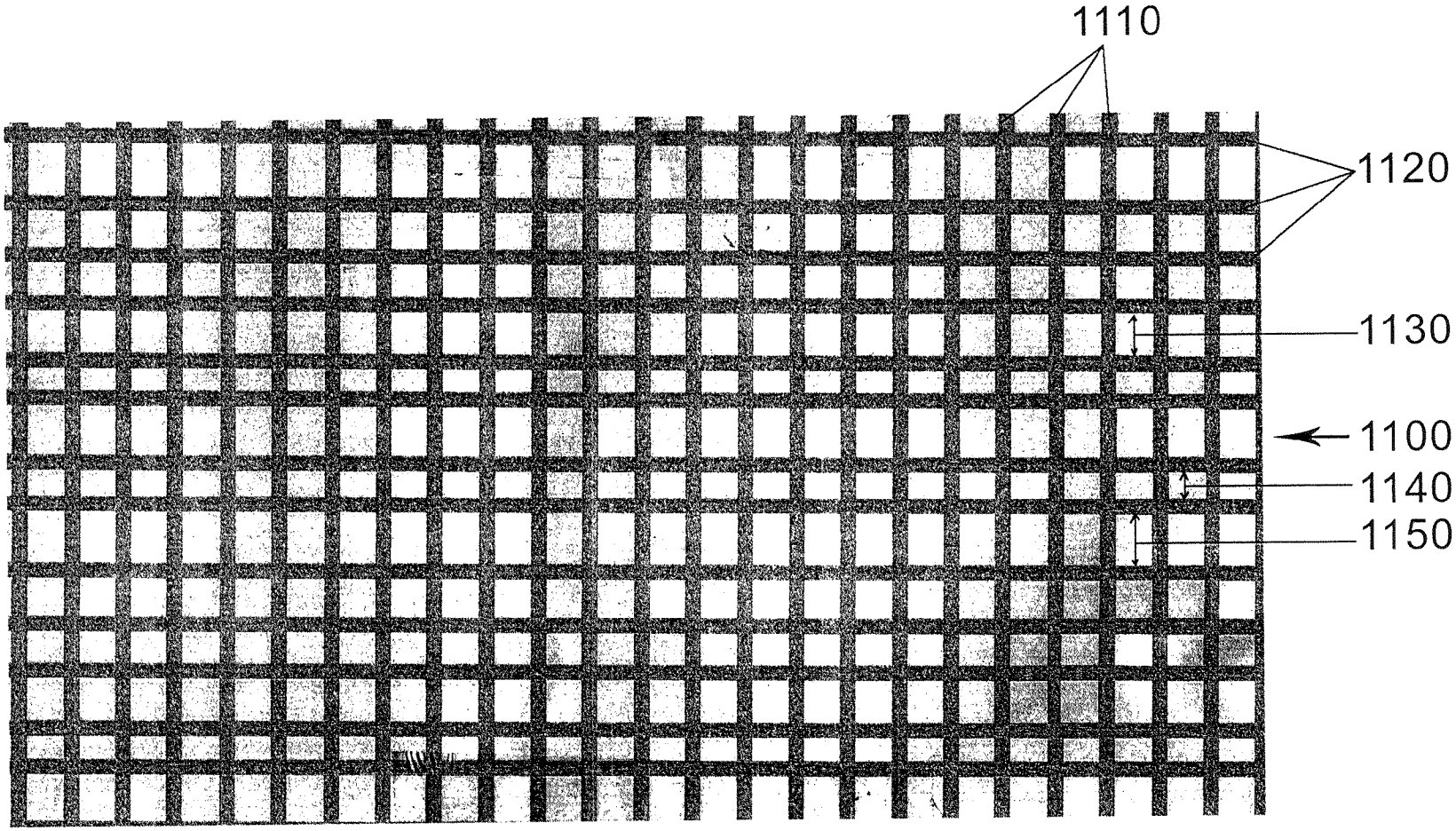
FIG. 11 is a layer of a multilayer multiaxial fabric having variable CD yarn spacing in accordance with the first embodiment of the present invention.

FIG. 11 is another example of a layer with weave pattern having variable CD spacing. FIG. 11 is a layer 1100 having a plurality of MD yarns 1110 and CD yarns 1120 with non-uniform CD spacing. That is, the distance between pairs of adjacent CD yarns are different. For example, a first distance 1130, a second distance 1140 and a third distance 1150 are different and so on.

Note that while the MD yarns 1110 are shown to be at a uniformed spaced distance from each other, variation of such spacing is envisaged as part of the present invention. In this regard, the predetermined spaced distances between pairs of adjacent MD yarns may be achieved by, for example, non-uniform reed dent spacing, multiple diameter MD strands, or non-uniform reed dent insertion of yarns among others. Other ways of producing variable predetermined distances between pairs of adjacent MD yarns would be readily apparent to those so skilled in the art.

Turning now to the second embodiment of the present invention, it involves the use of the nonwoven layer 1230 between the multiaxial layers 1210 and 1220 which serves to create void volume and preserve fabric openness. Also the interference pattern that commonly occurs between multiaxial layers is reduced or eliminated by disposing a nonwoven layer between a first (upper) woven layer and a second (lower) woven layer of a multiaxial fabric. The nonwoven layer may include materials such as knitted, extruded mesh, MD or CD yarn arrays, and full width or spiral wound strips of nonwoven fiberous material.

Figure 12:
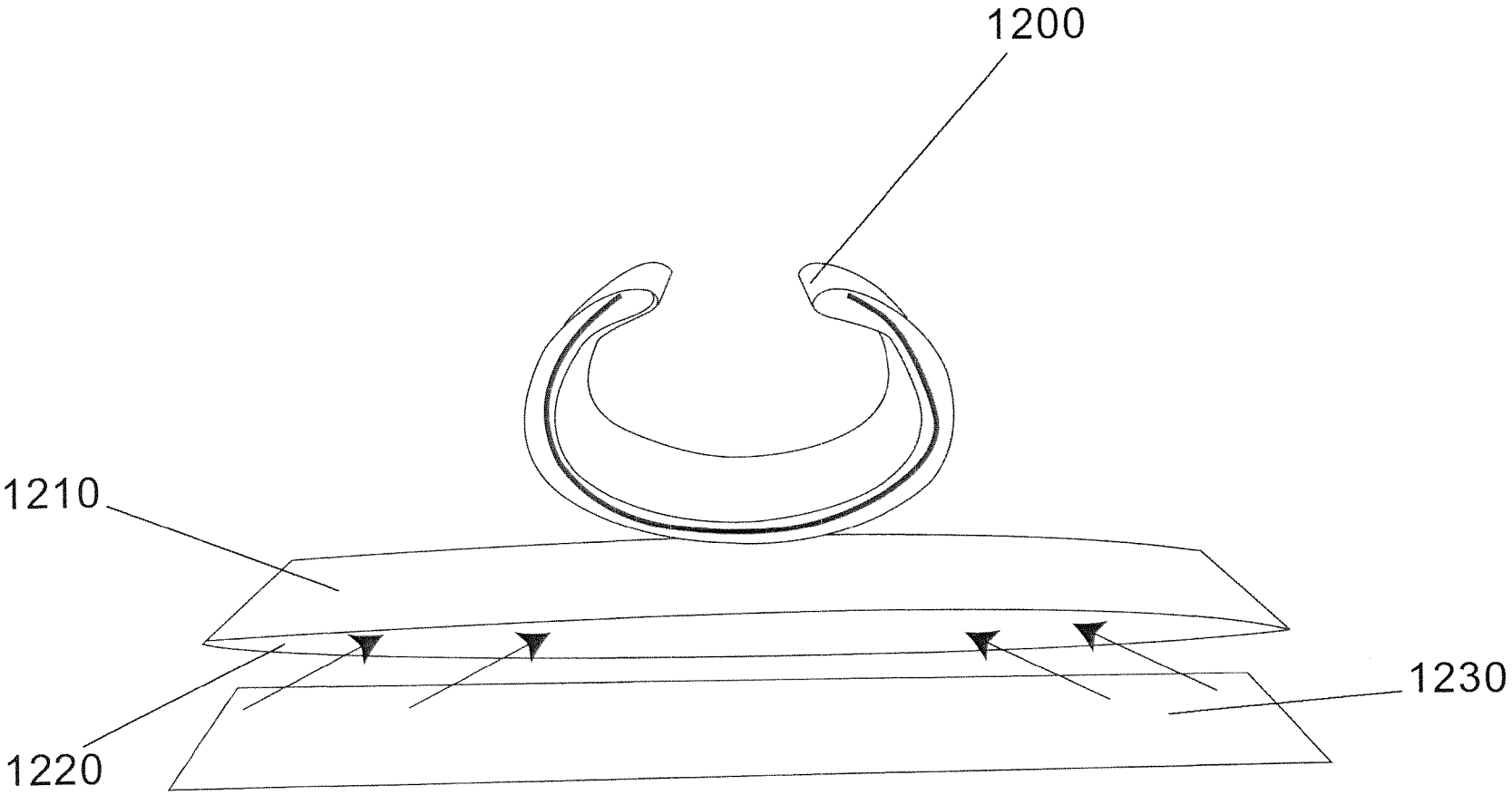
FIG. 12 is a multilayer multiaxial fabric in accordance with the second embodiment of the present invention.

This is illustrated in FIG. 12 which is an on-machine seamable multilayer multiaxial fabric 1200. Upper layer 1210 and lower layer 1220 are made into the form of an endless fabric as provided in U.S. Pat. No. 5,360,656 to Rexfelt et al. with a nonwoven layer 1230 is disposed between upper woven layer 1210 and lower woven layer 1220. Nonwoven layer 1230 may be that as aforesaid and typically comprises a sheet or web structure bonded together by entangling fiber or filaments mechanically, thermally or chemically. It may be made of any suitable material, such as polyamide and polyester resins, used for this purpose by those of ordinary skill in the paper machine clothing arts. Nonwoven layer 1230 may be disposed between upper woven layer 1210 and lower woven layer 1220 by any means so known by those skilled in the art. After nonwoven layer 1230 is disposed between upper layer 1210 and lower layer 1220, the fabric 1200 may be rendered into endless form with a seam as taught by the '274 patent.

In yet the third embodiment in accordance with the present invention, the topography of a multilayer multiaxial fabric may be made more planar by flattening one side of each layer that forms the multilayer multiaxial fabric. Specifically, the multiaxial fabric when flattened upon itself along a first and second fold line and made on-machine-seamable as taught in the '176 patent can be considered to have an upper layer having a plurality of interwoven MD and CD yarns having an inner side and an outer side; and a lower layer having a plurality of interwoven MD and CD yarns having an inner side and an outer side. The knuckles or yarn crossovers of the inner side of the upper layer and the inner side of the lower layer may be flattened by a predetermined technique such as calendering. The predetermined technique as aforesaid may be any process that flattens knuckles on each of the layers so as to improve pressing uniformity and reduce sheet marking. For example, one predetermined technique may be calendering one side of each layer at the appropriate pressure speed and temperature to flatten knuckles. The multilayer multiaxial fabric is then assembled so that the smooth sides of the two layers, after flattening, are in contact with each other (smooth side on the smooth side). The calendered fabric with two smooth inner surfaces should have reduced caliper variation because the layers of the fabric will less likely nest in a given area. Nesting occurs whenever the yarns or knuckles of one fabric layer shift or nest into the openings between yarns or knuckles of the other layer. The interference pattern may still be visible to a certain extent but the potentially harmful caliper variation may be significantly reduced thus improving pressure distribution. Note that a similar approach may be taken to the layers making up a fabric taught in the '656 patent.

Figure 13:
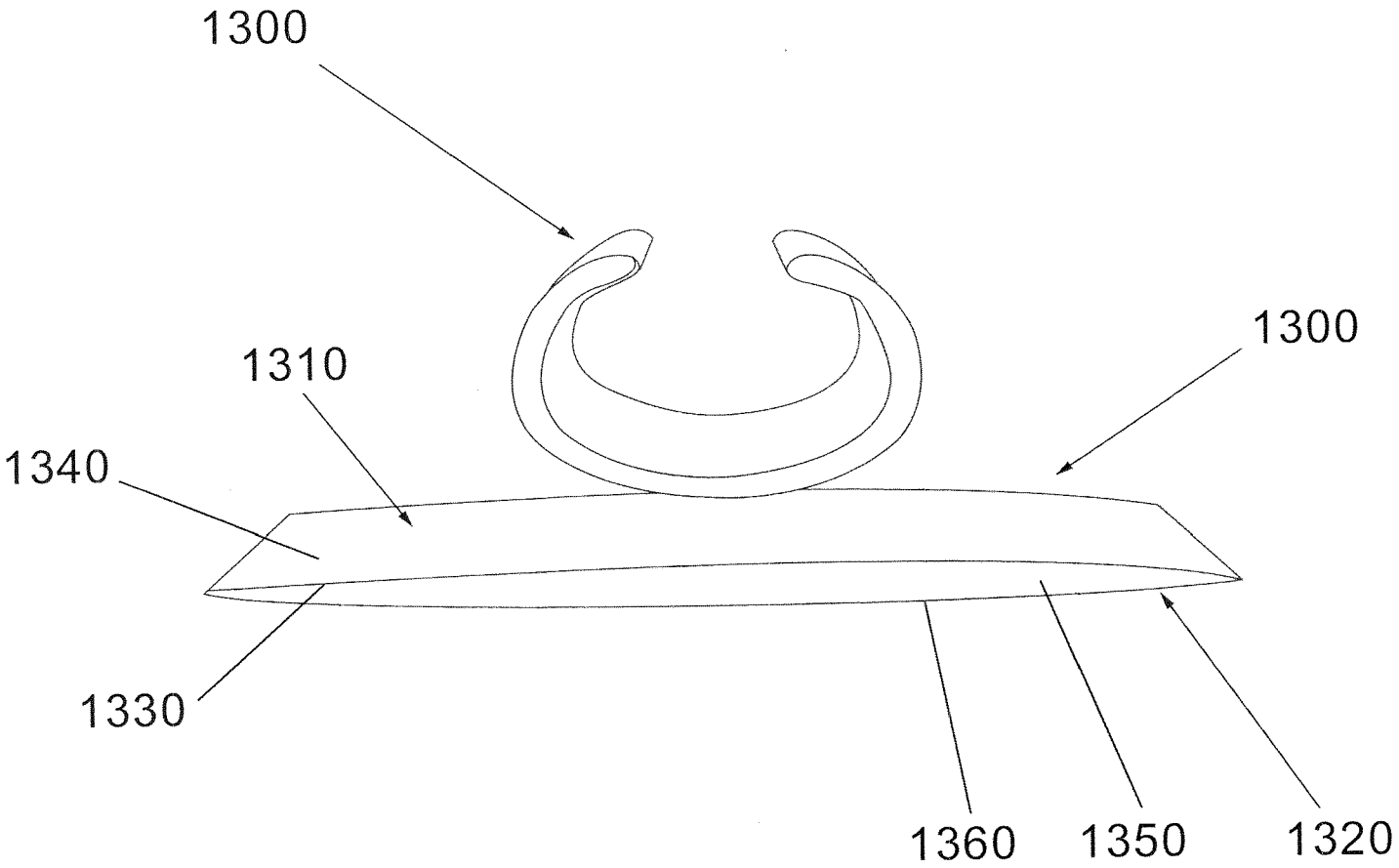
FIG. 13 is a multilayer fabric in accordance with the third embodiment of the present invention.

FIG. 13 illustrates a multilayer multiaxial fabric 1300 which is formed by an endless single layer multiaxial fabric folded upon itself to create a double layer fabric and rendered on-machine-seamable in a manner discussed, for example, in the aforenoted '176 patent. After folding the multiaxial fabric 1300 has alternatively a first layer 1310 and a second layer 1320. First layer 1310 includes inner side 1330 and outer side 1340. Similarly, second layer 1320 includes inner side 1350 and outer side 1360. One or both of the inner side or outer side of each layer, for example, inner sides 1330 and 1350, may be, for example, calendered to flatten the knuckles of the woven layer so that the caliper variation is reduced.

In yet a fourth embodiment in accordance with the present invention, the layers of a multiaxial fabric may each be formed by mixing different weave repeats or shed patterns. The number of yarns intersected before a weave pattern repeats is known as a shed. For example, a plain weave can therefore be termed a two shed weave. By mixing the shed patterns in a fabric, for example, a 2-shed pattern with a 3-shed pattern, a shute in the 3-shed weave may zigzag or interlace between ends of the 2-shed weave. The interlacing yarn between the 2-shed ends may reduce caliper variation and improve pressing uniformity. The interlacing yarn may be in the machine direction and/or the cross-machine direction.

Figure 14:
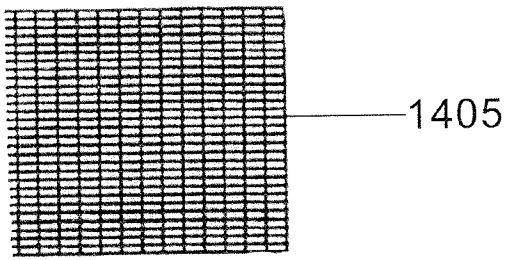
FIG. 14 is a regular plain weave strip of multiaxial material.

FIG. 14 is a representation of a layer 1405 of regular plain weave strip of multiaxial material. FIG. 14*a* is a representation of a layer 1410 of a multiaxial fabric 1400. FIG. 14*b* shows 1410 folded upon itself to create a multilayer multiaxial fabric 1400. Multiaxial fabric 1400 includes a first layer 1410 and a second layer 1420. First layer 1410 includes a plurality of interwoven MD yarns 1412 and CD yarns 1414. Similarly, second layer 1420 may include a plurality of MD yarns 1422 and CD yarns 1424. The arrangement of the MD and CD yarns in first layer 1410 and second layer 1420 which, due to spiraling are at an angle to one another, improves the pressure distribution of the fabric during operation as well as the Moire Effect. First layer 1410 and second layer 1420 are formed from mixing weave repeats, for example, a 2-shed pattern with a 3-shed pattern. Specifically, in first layer 1410, as shown in FIG. 14*a*, CD yarn 1426 interlaces between the 2-shed ends 1430 and 1432. Similarly, in second layer 1420 CD yarn 1428 interlaces between the 2-shed ends 1434 and 1436. As a result, caliper variation is reduced and pressing uniformity is improved. Notably, as shown in FIG. 14(*b*), there are no continuous or well defined MD or CD bands.

Figure 14C:
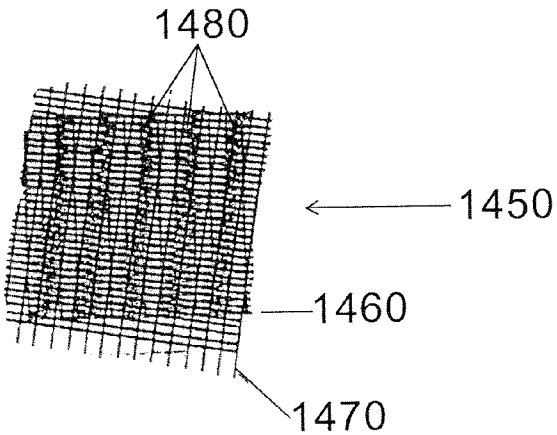
FIG. 14*c* depicts a pattern for a multilayer prior art fabric formed of two layers of two standard weave patterns offset from one another at a typical desired angle.
Figure 14A:
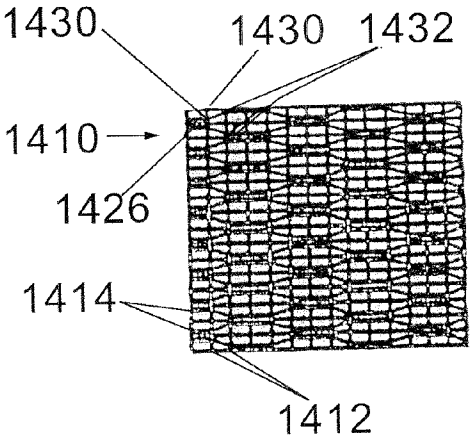
FIG. 14*a* depicts a layer of strips of multiaxial material having desired shed patterns.
Figure 14B:
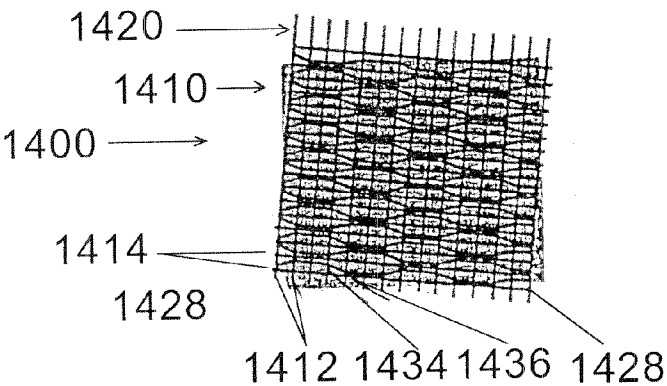
FIG. 14*b* depicts an interference pattern for a multilayer fabric formed of two patterns offset from one another in accordance with a fourth embodiment of the present invention.

In contrast, FIG. 14*c* illustrates layer 1405 folded upon itself to create a typical multilayer multiaxial fabric 1450 including first woven layer 1460 and second woven layer 1470. As shown, the plain weave multiaxial fabric 1450 upon being folded results in noticeable MD bands 1480. MD bands 1480 may be areas of different caliper, mass or pressure uniformity which may mark the paper sheet during a pressing operation. Note further that while it is illustrated that the multiaxial fabric is being folded on itself to create a multilayer fabric, in the situation of a multilayer fabric as taught by the '656 patent the same principal would apply.

Interlacing between shed patterns may be in the MD and/or CD directions. Further, the interlacing yarn may be in the first layer and/or second layer. Also, any shed combination that produces an interlacing yarn is envisioned in the present invention. For example, an interlacing yarn may be present by mixing a 2-shed pattern with a 5-shed pattern, a 3-shed pattern and a 4-shed pattern and so forth. Furthermore, even if only one of the two layers of the multilayer fabric includes this multi-shed weave, an appreciable improvement in the interference pattern should be realized. Also, the invention is not limited to a specific number of fabric layers, i.e. two, rather it is applicable to more than two. Also a fiberous batt layer or layers may also be attached by needling.

Figure 15A:
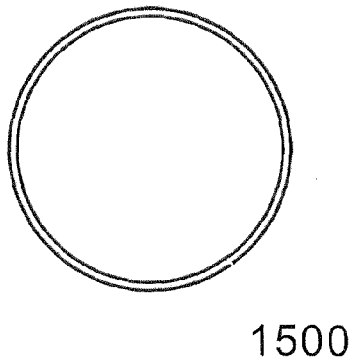
FIG. 15A depicts a representative multiaxial base fabric.
Figure 15B:
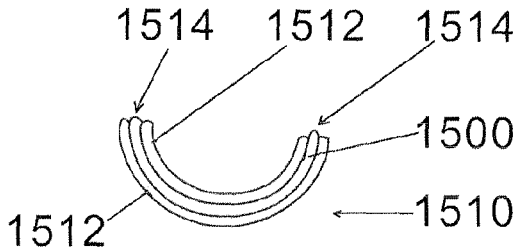
FIGS. 15B-D depicts multilayer multiaxial fabrics incorporating laminate material in accordance with the fifth embodiment.
Figure 15C:
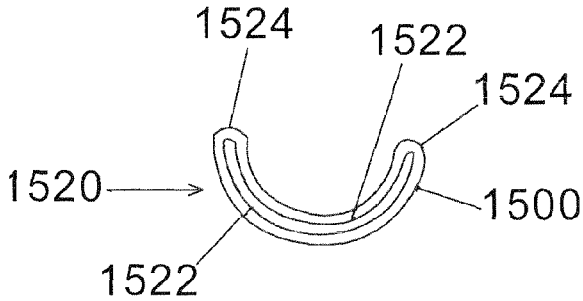
Figure 15D:
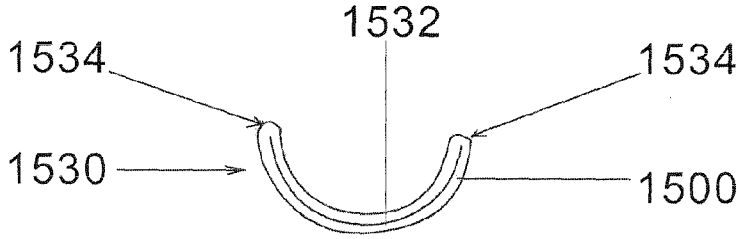

Turning now to the fifth embodiment in FIG. 15A, an endless single layer multiaxial base fabric 1500 is shown. This fabric 1500 can be created in any manner heretofore discussed. Note that in the to be seam area, the cross-machine direction yarns are removed for seaming purposes in accordance with the teachings of the '176 patent. FIGS. 15B-D show further multilayer variations that are envisioned by the present invention. In this regard a multilayer fabric 1510 is shown in FIG. 15B. It is created by adding a laminate material 1512 to the outside of base fabric 1500 and needling the fabric with laminate to attach the same. Note the laminate may be any material suitable for the purpose, such as that described with regard to the second embodiment or even batt. This applies to all versions of the fifth embodiment.

The fabric would then be removed from the needle loom with the laminate material cut away in the loop area 1514. The fabric 1510 is folded on itself as shown and then seamed in a manner as taught in the '176 patent. The resulting fabric 1510 would have two layers formed from base fabric 1500 and a layer of laminate material 1512 on the top and one on the bottom.

Turning now to FIG. 15C another multilayer fabric 1520 is shown utilizing base fabric 1500. In this embodiment, the laminate material 1522 is attached to the inside of base fabric 1500 by needling. The fabric is then removed from the needling loom and the laminate cut away in the loop areas 1524. The fabric 1520 is then folded upon itself and seamed in a manner as taught in the '176 patent. The resulting fabric 1520 would have two layers of laminate material 1522 inside two layers of base fabric 1500.

With regard now to FIG. 15D, there is shown fabric 1530 which is a multilayer fabric. In this version it too utilizes the base fabric 1500. A laminate material 1532 is placed on the top outside of the base fabric 1500 and needled thereto for one-half the length of the fabric between the loop areas 1534. The remaining laminate material not needled is removed by cutting. The fabric 1530 is removed from the needle loom and turned inside out and folded upon itself and again seamed in a manner taught by the '176 patent. The resulting fabric would have two layers of base fabric 1500 with a layer of laminate 1532 inside.

A variation of this would be to place a laminate material on the inside of a base fabric 1500 and needle the fabric between the loop areas, remove the excess laminate material not needled, fold it upon itself and seam as aforesaid. The fabric will have the same construction as fabric 1530.

Modifications to the above would be obvious to those of ordinary skill in the art, but would not bring the invention so modified beyond the scope of the present invention. The claims to follow should be construed to cover such situations.

What is claimed is:

1. A multilayer multiaxial fabric for use with a paper machine, said fabric comprising:

an upper layer having a plurality of interwoven machine direction (MD) and cross-machine direction (CD) yarns;

a lower layer having a plurality of interwoven MD and CD yarns, wherein a relative angle or offset is formed between the MD yarns of the upper layer with the MD yarns of the lower layer, and a relative angle or offset is formed between the CD yarns of the upper layer with the CD yarns of the lower layer such that neither the MD yarns nor the CD yarns of the upper layer align with the MD yarns or the CD yarns of the lower layer; and a nonwoven layer disposed between said upper layer and said lower layer to reduce an interference pattern or Moire Effect between the layers making up the multiaxial fabric.

2. The multiaxial fabric as claimed in claim 1, wherein said nonwoven layer comprises a knit, an extruded mesh, MD and/or CD yarn arrays, or full width or spirally wound strips of nonwoven fibrous material.

3. The multiaxial fabric as claimed in claim 1, wherein said multiaxial fabric is on-machine-seamable.

4. The multiaxial fabric as claimed in claim 1, wherein said multiaxial fabric is a press fabric for a paper machine and includes one or more layers of fibrous batt needled thereto.

5. A method of forming a multilayer multiaxial fabric for use in papermaking, said method comprising the steps of:

interweaving a plurality of machine direction (MD) and cross-machine direction (CD) yarns to form an upper layer;

interweaving a plurality of MD and CD yarns to form a lower layer, and forming a relative angle or offset between the MD yarns of the upper layer with the MD yarns of the lower layer, and forming a relative angle or offset between the CD yarns of the upper layer with the CD yarns of the lower layer such that neither the MD yarns nor the CD yarns of the upper layer align with the MD yarns or the CD yarns of the lower layer; and disposing a nonwoven layer between said upper layer and said lower layer to reduce an interference pattern or Moire Effect between the layers making up the multiaxial fabric.

6. The method as claimed in claim 5, wherein said upper layer and said lower layer form an endless loop.

7. The method as claimed in claim 6, further comprising the step of joining said upper and lower layers together by needling.

8. The method as claimed in claim 7, further comprising the step of seaming ends together.

* * * * *